US005243797A

United States Patent [19]

Koenig, Jr.

[11] Patent Number: 5,243,797

[45] Date of Patent: Sep. 14, 1993

[54] DRYWALL FINISHING AND MASKING ACCESSORY

[75] Inventor: Joseph M. Koenig, Jr., Lincolnwood, Ill.

[73] Assignee: Trim-Tex, Inc., Lincolnwood, Ill.

[21] Appl. No.: 861,145

[22] Filed: Mar. 31, 1992

Related U.S. Application Data

[63] Continuation-in-part of Ser. No. 855,597, Mar. 20, 1992, abandoned.

[51] Int. Cl.[5] ..... E04F 13/06

[52] U.S. Cl. ..... 52/254; 52/288; 52/716.1

[58] Field of Search ..... 52/287, 288, 254, 255, 52/256, 257, 127.5, 716.1, 236.9, 364, 416, 417

[56] References Cited

U.S. PATENT DOCUMENTS

| | | | |
|---|---|---|---|
| 2,552,159 | 5/1951 | Eason . | |
| 2,843,889 | 7/1958 | Keller . | |
| 3,007,213 | 11/1961 | Hobbs | 52/288 |
| 3,287,867 | 11/1966 | Aton . | |
| 3,290.838 | 12/1966 | Van Bael . | |
| 4,074,478 | 2/1978 | Rutherford . | |
| 4,587,781 | 5/1986 | Uttley et al. . | |
| 4,843,783 | 7/1989 | Taravella . | |
| 4,912,899 | 4/1990 | Plasker et al. | 52/287 |
| 4,982,540 | 1/1991 | Thompson . | |

OTHER PUBLICATIONS

Trim-Tex Inc. Brochure; Mar. 1991.

Affidavit of Wesley Dunham in Civil Action No. 89 C 6306 with Exhibit 1 attached. Sep. 4, 1991.

*Primary Examiner*—Michael Safavi

*Attorney, Agent, or Firm*—Dressler, Goldsmith, Shore, Sutker & Milnamow, Ltd.

[57] ABSTRACT

A wall construction comprises a ceiling or wall structure having an exposed surface, a drywall panel having an edge near such surface, and an accessory comprising a bead for finishing the edge and a separate, removable strip for masking a portion of such surface to prevent drywall finishing material or paint from being deposited on the masked portion. The bead has a generally L-shaped profile with a surface-engaging leg secured to and engaged with a panel surface, with an edge-covering leg extended inwardly over the panel edge, and with a generally U-shaped lip joining the legs. A generally J-shaped portion of the edge-covering leg defines a channel opening toward the lip, grasping an inner portion of the strip releasably, and having an edge spaced inwardly from the lip. An outer portion of the strip extends beyond the lip and performs such masking function.

17 Claims, 1 Drawing Sheet

Fig. 1
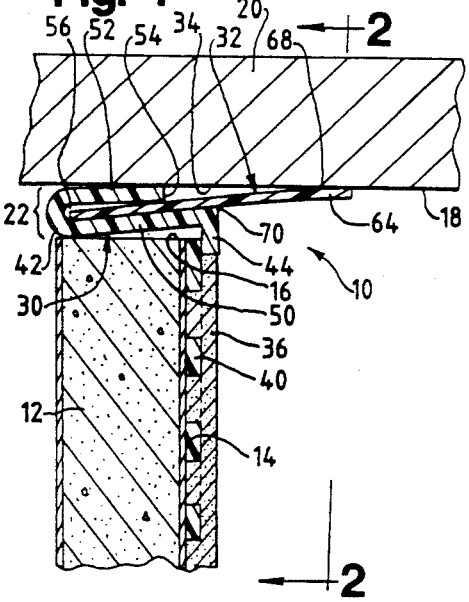
Fig. 3
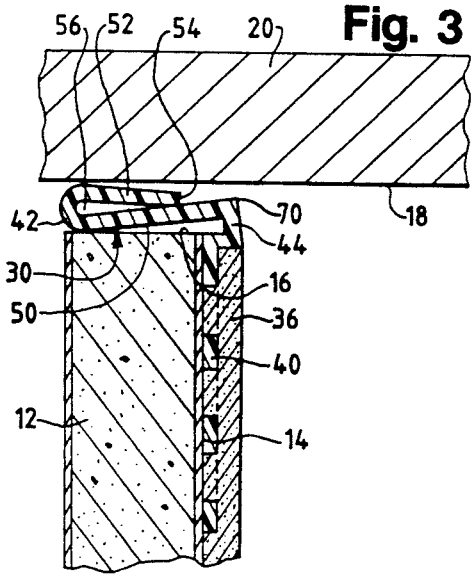
Fig. 2
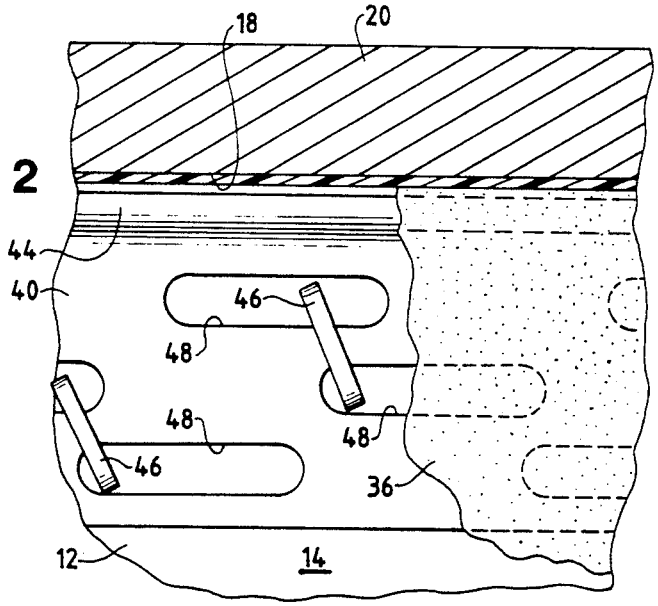
Fig. 4
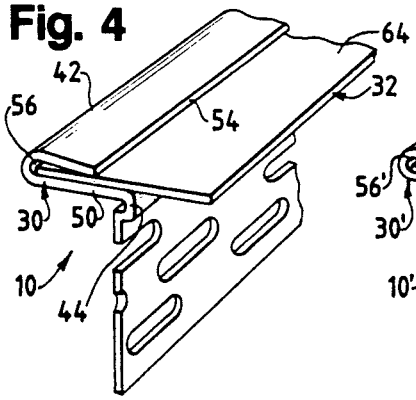
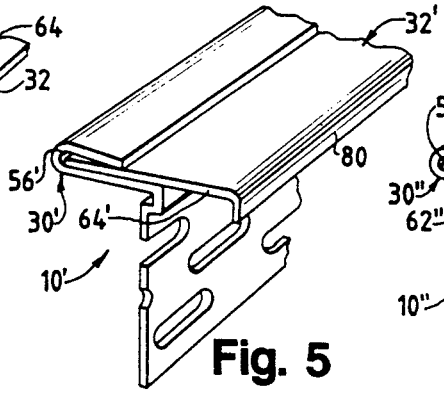
Fig. 5
Fig. 6
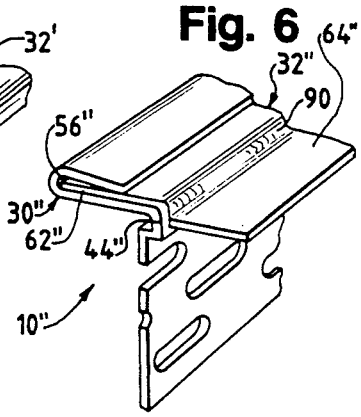

DRYWALL FINISHING AND MASKING ACCESSORY

CROSS-REFERENCE TO RELATED APPLICATION

This application is a continuation-in-part of U.S. patent application Ser. No. 07/855,597 filed Mar. 20, 1992 now abandoned, by Joseph M. Koenig, Jr., and entitled "Drywall Finishing and Masking Accessory".

TECHNICAL FIELD OF THE INVENTION

This invention pertains to a finishing and masking accessory useful with a drywall panel having an outer surface and having a top or side edge near an exposed surface of an adjacent structure. The finishing and masking accessory comprises a bead for finishing the panel edge near the adjacent surface and a separate, removable strip for masking a portion of the exposed surface to prevent drywall finishing material, wallpapering adhesive, or paint from being deposited on the masked portion. The strip is grasped releasably in a pocket or channel defined by portions of the bead so that the strip can be pulled from the bead without tearing, breaking, or cutting the bead or the strip.

BACKGROUND OF THE INVENTION

Commonly, in interior building construction, a drywall panel is erected so that its top or side edge is near an exposed surface of an adjacent structure, such as an acoustic tile ceiling, a masonry wall, or a window frame. It is common to leave a small gap between the panel edge and the exposed surface to accommodate a bead of a type having a generally L-shaped profile defining two legs joined by a generally U-shaped lip. One such leg is engaged with an outer surface of the drywall panel and is secured to the drywall panel, as by staples or nails, so that the other leg extends inwardly and covers at least part of the panel edge. A bead of the type noted above, extruded from rigid poly(vinyl chloride) known commonly as rigid PVC, has been sold for many years by Trim-Tex Inc. of Lincolnwood, Ill., under the trade designation "L Bead". Such a bead may be also called a trim bead, an edge bead, or a finishing bead.

Drywall finishing material of a type commonly known as joint compound, masking compound, or drywall "mud" is spread onto the leg secured to the drywall panel, and onto an adjacent portion of the outer surface of the drywall panel, usually by means of a wide trowel guided by the lip and by the panel surface. After such material has dried sufficiently, adjacent portions of the outer surface of the drywall panel, the exposed surface of the finishing material, and any exposed surface of the lip of the bead may be then painted or wallpapered.

Another trim or finishing bead known heretofore has a tear-away strip extending outwardly from the lip. The tear-away strip is used to mask a portion of an adjacent surface so as to prevent drywall finishing material from engaging the masked portion. The tear-away strip can be torn away, along a weakened line, when such strip is no longer needed. Another known bead for similar uses has a paper masking strip attached adhesively to the edge-covering leg so as to extend outwardly from the lip. The paper masking strip can be cut away from the finishing bead.

Van Bael U.S. Pat. No. 3,290,838 discloses a casement bead having a plastering splash apron, which comprises a strip of flexible material attached to the casement bead. The strip has a line of perforations spaced inwardly from a corner of the casement bead. When a lower portion of the strip is broken away, along the line of perforations, an upper portion of the strip remains hidden within a narrow gap between the casement bead and an adjacent surface.

Rutherford U.S. Pat. No. 4,074,478 discloses a casing bead of related interest, apparently made of thin sheet metal, with a tear strip that can be torn away along a scored line directly opposite the lip. Uttley et al. U.S. Pat. No. 4,587,781 and Thompson U.S. Pat. No. 4,982,540 disclose drywall trim pieces of related interest, generally T-shaped in cross-section, without tear-away strips. Taravella U.S. Pat. No. 4,843,783 discloses a casing trim of related interest, with an inwardly opening channel receiving a flat vinyl strip.

SUMMARY OF THE INVENTION

This invention provides a finishing and masking accessory of a novel construction. The accessory is useful with a drywall panel having its top or side edge near an exposed surface of an adjacent structure. The accessory comprises a bead for finishing the panel edge and a separate, removable strip for masking a portion of the exposed surface to prevent drywall finishing material, wallpapering adhesive, or paint from being deposited on the masked portion. Being separate from the bead and being grasped releasably in a pocket or channel, the strip can be pulled from the bead without tearing, breaking, or cutting the bead or the strip.

In a preferred form, the bead has a profile defining a surface-engaging leg, an edge-covering leg, and a lip adjoining at least one of the legs. Thus, the bead may have a generally L-shaped profile. The surface-engaging leg is adapted to engage the outer surface of the drywall panel, near the panel edge. The edge-covering leg has a covering portion adapted to extend inwardly over the panel edge so as to cover at least part of the panel edge and a flange portion extending outwardly toward the lip. The covering and flange portions define the pocket or channel. The strip has an inner portion extending into the pocket or channel and an outer portion extending beyond the lip. The strip is grasped releasably in the pocket or channel, between the covering and flange portions, so that the strip can be pulled from the bead without breaking, tearing, or cutting the bead or the strip. Preferably, the edge-covering leg terminates in a generally J-shaped profile defining the channel, and the flange portion has a distal edge spaced inwardly from the lip.

Preferably, when the sheet is unstressed, the strip has a flat profile. Alternatively, the outer portion of the strip has a profile defining a flange to facilitate pulling the strip from the bead. In another contemplated alternative, the strip has a stepped profile defining a transitional portion between the inner and outer portions. The transitional portion masks a portion of the lip to prevent drywall finishing material, wallpapering adhesive, or paint from engaging the covered portion of the lip.

These and other objects, features, and advantages of this invention are evident from the following description of a preferred embodiment of this invention with reference to the accompanying drawings.

BRIEF DESCRIPTION OF THE DRAWINGS

FIG. 1 is a fragmentary, cross-sectional view of a finishing and masking accessory comprising a finishing bead and a masking strip and constituting a preferred embodiment of this invention. The accessory is shown as used with a drywall panel having one edge near an exposed surface of an adjacent structure. Drywall finishing material is shown.

FIG. 2 is a fragmentary, sectional view taken along plane 2—2 in FIG. 1, in a direction indicated by arrows. Some of the finishing material shown in FIG. 1 is omitted in FIG. 2 to show staples securing the finishing bead to the drywall panel.

FIG. 3 is a view similar to FIG. 1 but shows the finishing bead after the masking strip has been removed.

FIG. 4 is a fragmentary, perspective view of one end of the finishing and masking accessory shown in FIG. 1.

FIG. 5 is a fragmentary, perspective view of one end of a finishing and masking accessory according to one alternative embodiment of this invention.

FIG. 6 is a fragmentary, perspective view of one end of a finishing and masking accessory according to another alternative embodiment of this invention.

DETAILED DESCRIPTION OF PREFERRED EMBODIMENT

As shown in FIGS. 1 through 4, a finishing and masking accessory 10 constitutes a preferred embodiment of this invention. The accessory 10 is shown in FIGS. 1, 2, and 3 as used with a drywall panel 12 having an outer surface 14 and having a top or side edge 16 near an exposed surface 18 of an adjacent structure 20, such as a ceiling or wall structure or a window frame. A narrow gap 22 is left between the panel edge 16 and the exposed surface 18.

Broadly, the accessory 10 comprises a bead 30 for finishing the panel edge 16 and a separate, removable strip 32 for masking a portion 34 of the exposed surface 18 to prevent drywall finishing material 36 from being deposited on the masked portion. The bead may be alternatively described as a trim bead or a finishing bead. The masking strip 32 can be pulled from the bead 30 without tearing, breaking, or cutting.

The bead 30 has a generally L-shaped profile defining, as unitary elements, a surface-engaging leg 40, an edge-covering leg 42, and a generally U-shaped lip 44 joining the legs 40, 42. Each of the legs 40, 42, may be alternatively regarded as a trim strip. The surface-engaging leg 40 is adapted to engage the outer surface 14 of the drywall panel 12, near the panel edge 16. The edge-covering leg 42 is adapted to extend inwardly over the panel edge 16 so as to cover the panel edge 16. As shown in FIGS. 1, 2, and 3, the surface-engaging leg 40 is engaged with the panel surface 14, near the panel edge 16, and is secured to the drywall panel 12 via staples 46 (see FIG. 2) in a known manner. The surface-engaging leg 40 has a pattern of elongate slots 48, which facilitate stapling such leg 40 to the drywall panel 12, and which receive drywall finishing material spread onto the leg 40 so as to facilitate bonding between such material and the leg 40. As shown in FIGS. 1 and 3, the edge-covering leg 42 has a covering portion 50 extending over the panel edge 16 and covering such edge 16.

The bead 30 is extruded from a polymeric material, preferably rigid PVC having a thickness of approximately 0.034 inch. The strip 32 is made from a sheet-form material, preferably rigid PVC having a thickness of approximately 0.015 inch. Preferably, therefore, the strip 32 is less than one half as thick as the bead 30.

Rigid PVC is a preferred material for the bead 30 and the strip 32 because of its flexibility, extrudability, and compatibility with drywall finishing material, wallpapering adhesive, and paint. The bead 30 may be alternatively made from thin sheet metal. The strip 32 may be alternatively made from cardboard, heavy paper, which may be folded into plural layers, or thin metal sheet. Preferably, the bead 30 is white to provide a suitable background for painting, and the strip 32 is colored with a contrasting color to enhance its visibility. The bead 30 may be pre-primed, at least along the lip 44, with a painting primer.

As shown in FIGS. 1 and 3, the edge-covering leg 42 terminates in a generally J-shaped profile defining a flange portion 52 turned and extended outwardly. A distal edge 54 of the flange portion 52 is spaced inwardly from the lip 44 and bears against the edge-covering leg 42, as shown in FIG. 3, when the flange 52 is unstressed. The covering portion 50 and the flange portion 52 define a pocket or channel 56.

The masking strip 32 has an inner portion 62 extending into the channel 56, in which the strip 32 is grasped releasably between the flange portion 52 and the covering portion 50, and an outer portion 64 extending beyond the lip 44. Preferably, as shown in FIG. 4, the strip 32 has a flat profile when the strip 32 is unstressed. The flange portion 52 is stressed slightly when the strip 32 is grasped releasably between the flange portion 52 and the covering portion 50. The outer portion 64 of the strip 32 masks the previously mentioned portion 34 of the exposed surface 18 of the adjacent structure 20 to prevent drywall finishing material, wallpapering adhesive, or paint from being deposited on the masked portion 34.

As grasped releasably between the flange portion 52 and the covering portion 50, the strip 32 can be pulled from the bead 30, along a line of separation spaced inwardly from the lip 44. The line of separation is defined by the distal edge 54 of the flange portion 52. Because the distal edge 54 is spaced inwardly from the lip 44, and because a major part of the narrow gap 22 between the panel edge 16 and such surface 18 is filled by the lip 44, the distal edge 54 cannot be easily seen once the strip 32 has been removed.

Usually, a user can remove the strip 32 from the bead 30 with his or her fingertips, without needing to use a tool. In some circumstances, however, the user may use a thin blade (not shown) to bend the outer portion 64 of the strip 32 downwardly from the adjacent structure 20 or a pair of pliers (not shown) to pull the strip 32 from the bead 32. However, there is no need to break, tear, or cut the bead 30 or the strip 32 to remove the strip 32.

The strip 32 may be removed from the bead 30 immediately after drywall finishing material 36 has been spread along the lip 44, onto the surface-engaging leg 44, and onto an adjacent portion 66 of the panel surface 14. Preferably, however, the finishing material 36 is allowed to dry before the strip 32 is removed. Exposed, adjacent portions of the outer surface 14 of the drywall panel 12, the exposed surface of the finishing material 36, and any exposed surface of the lip 44 of the finishing bead 30 may be painted after the finishing material 36 has dried sufficiently, before the strip 32 removed.

As shown in FIGS. 1, 3, and 4, the edge-covering leg 42 and the surface-engaging leg 40 define therebetween an angle equal approximately to a right angle. However, such legs 42, 40, do not define a true right angle relative to each other but define a slightly smaller angle (e.g. approximately 83°) relative to each other. Thus, the outer portion 64 of the strip 32 extends beyond the lip 44 so as to define a slightly greater angle (e.g. approximately 97°) relative to the surface-engaging leg 40. Consequently, as shown in FIG. 1, the outer portion 64 of the strip 32 tends to bear against the exposed surface 18 of the adjacent structure 20 and to form a sealing interface 68 where such portion 64 bears against such surface 18.

Desirably, the lip 44 has a sharp corner 70, as shown in FIG. 1 and other views, where the outer portion 64 of the strip 32 extends beyond the lip 44, so as not to form a crevice. If a crevice happens to be nonetheless formed where the outer portion 64 of the strip 32 extends beyond the lip 44 and if drywall finishing material happens to be accidentally spread into the crevice, the strip 32 enables such material to be scraped from the crevice with little risk of damaging the exposed surface 18 of the adjacent structure 20.

In one alternative embodiment contemplated by this invention, as shown in FIG. 5, a finishing and masking accessory 10' comprises a bead 30' and a separate, removable strip 32'. The bead 30' is similar to the bead 30 of the accessory 10 and has a channel 56' similar to the channel 56 of the bead 30. The strip 32' is similar to the strip 32 of the accessory 10, except that the strip 32' has an outer portion 64' defining a flange 80, which extends away from the adjacent structure 20. The strip 32' is grasped releasably in the channel 56' of the bead 30' as the strip 32 is grasped releasably in the channel 56 of the bead 30. The flange 80 facilitates pulling the strip 32' from the bead 30'.

In another alternative embodiment contemplated by this invention, a finishing and masking accessory 10'' comprises a bead 30'' and a separate, removable strip 32''. The bead 30'' is similar to the bead 30 of the accessory 10 and has a lip 44'' similar to the lip 44 of the bead 30 and a channel 56'' similar to the channel 56 of the bead 30. The strip 32'' has a stepped profile defining a transitional portion 90 between an inner portion 62'' and an outer portion 64''. The strip 32'' is grasped releasably in the channel 56'' of the bead 30'' as the strip 32 is grasped releasably in the channel 56 of the bead 30. The transitional portion 90 masks a portion of the lip 44'' so as to prevent drywall finishing material, wallpapering adhesive, or paint from engaging the masked portion of the lip 44''.

Various other modifications may be also made in the finishing and masking accessory described above without departing from the scope and spirit of this invention.

I claim:

1. A wall construction comprising a structure having an exposed surface, a drywall panel having an edge near the exposed surface, and a finishing and masking accessory comprising a bead for finishing the panel edge near the exposed surface and a separate, removable strip for masking a portion of the exposed surface to prevent drywall finishing material from being deposited on the masked portion of the exposed surface; the bead having a generally L-shaped profile defining a surface-engaging leg secured to and engaged with the exposed surface near the panel edge, an edge-covering leg extended inwardly over the panel edge so as to cover at least part of the panel edge, and a generally U-shaped lip joining the legs and opening inwardly; the edge-covering leg terminating in a generally J-shaped profile defining a channel, the strip having an inner portion extending into the channel and an outer portion extending beyond the lip so as to mask a portion of the exposed surface, the strip being grasped releasably in the channel so that the strip can be pulled from the bead without breaking, tearing, or cutting the bead or the strip.

2. The wall construction of claim 1 further comprising drywall finishing material spread along the lip, onto the surface-engaging leg, and onto an adjacent portion of the outer surface of the drywall panel.

3. The wall construction of claim 1 wherein the edge-covering leg defines an angle slightly smaller than a right angle relative to the surface-engaging leg, wherein the outer portion of the strip defines an angle slightly greater than a right angle relative to the surface-engaging leg, and wherein the outer portion of the strip bears against the exposed surface of the adjacent structure.

4. The wall construction of claim 3 wherein the strip is less than one half as thick as the bead.

5. The wall construction of claim 3 wherein the lip defines a sharp corner where the outer portion of the strip extends beyond the lip.

6. A finishing and masking accessory useful with a drywall panel having an outer surface and having a top or side edge near an exposed surface of an adjacent structure, the finishing and masking accessory comprising a bead for finishing the panel edge near the adjacent surface and a separate, removable strip for masking a portion of the exposed surface to prevent drywall finishing material from being deposited on the masked portion; the bead having a profile defining a surface-engaging leg adapted to engage the outer surface near the panel edge, an edge-covering leg having a covering portion adapted to extend inwardly over the panel edge so as to cover at least part of the panel edge, and a generally U-shaped lip adjoining at least one of the legs; the edge-covering leg having a flange portion extended outwardly toward the lip, the covering and flange portions defining a channel, the strip having an inner portion extending into the channel and an outer portion extending beyond the lip, the strip being grasped releasably in the channel, between the covering and flange portions, so that the strip can be pulled from the bead without breaking, tearing, or cutting the bead or the strip.

7. The finishing and masking accessory of claim 6 wherein the generally U-shaped lip joins the legs.

8. The finishing and masking accessory of claim 6 wherein the edge-covering leg terminates in a generally J-shaped profile defining the flange portion, the flange portion having a distal edge spaced inwardly from the lip.

9. The finishing and masking accessory of claim 6 wherein the strip has a flat profile when the strip is unstressed.

10. The finishing and masking accessory of claim 6 wherein the outer portion of the strip has a profile defining a flange to facilitate pulling the strip from the bead.

11. The finishing and masking accessory of claim 6 wherein the strip has a stepped profile defining a transitional portion between the inner and outer portions, the transitional portion masking a portion of the lip.

12. The finishing and masking accessory of claim 6 wherein the edge-covering leg defines an angle slightly smaller than a right angle relative to the surface-engaging leg and wherein the outer portion of the strip defines an angle slightly greater than a right angle relative to the surface-engaging leg.

13. The finishing and masking accessory of claim 6 wherein the strip is less than one half as thick as the bead.

14. The finishing and masking accessory of claim 6 wherein the lip defines a sharp corner where the outer portion of the strip extends beyond the lip.

15. A trim bead comprising a pair of substantially planar, unitary trim strips defining therebetween an angle equal approximately to a right angle, one of the trim strips terminating in a flange portion that is turned outwardly, against said one trim strip, and that defines, together with said one trim strip, a pocket for receiving therewithin and removably retaining a masking strip, and combined with a masking strip received and removably retained within the pocket.

16. The trim bead of claim 15 comprising a generally U-shaped lip joining the trim strips.

17. The trim bead of claim 16 wherein the masking strip extends beyond the lip.

* * * * *